US009545981B1

(12) United States Patent
Ebrahimi

(10) Patent No.: US 9,545,981 B1
(45) Date of Patent: Jan. 17, 2017

(54) SPLIT STAND UP PADDLEBOARD

(71) Applicant: Shaine Shahin Ebrahimi, Carbondale, CO (US)

(72) Inventor: Shaine Shahin Ebrahimi, Carbondale, CO (US)

( * ) Notice: Subject to any disclaimer, the term of this patent is extended or adjusted under 35 U.S.C. 154(b) by 0 days.

(21) Appl. No.: 14/849,435

(22) Filed: Sep. 9, 2015

Related U.S. Application Data

(60) Provisional application No. 62/047,795, filed on Sep. 9, 2014.

(51) Int. Cl.
*B63B 35/79* (2006.01)

(52) U.S. Cl.
CPC ..... *B63B 35/7916* (2013.01)

(58) Field of Classification Search
CPC ..... B63B 1/00; B63B 35/79; B63B 35/7913; B63B 35/7926; B63B 35/7936; B63B 35/85; B63B 35/73; B63B 35/81
USPC ..... 114/61.1, 345; 441/40, 65, 74, 77
See application file for complete search history.

(56) References Cited

U.S. PATENT DOCUMENTS 2,153,939 A * 4/1939 Schaupp ..... B63B 35/83 441/77
2,413,985 A * 1/1947 Manson ..... B63C 9/04 441/40
9,248,890 B2 * 2/2016 Raaphorst ..... B63B 35/7926

* cited by examiner

*Primary Examiner* — Lars A Olson

(57) ABSTRACT

A split stand up paddle board is configured to provide stability for a top-heavy load. The split stand up paddle board has a first hull attached to first hull inboard upper connection flap. A second hull is attached to second hull inboard upper connection flap. An upper string connects the first hull inboard upper connection flap to the second hull inboard upper connection flap. The upper string prevents the first hull from collapsing against the second hull when under the top-heavy load.

6 Claims, 5 Drawing Sheets

SPLIT STAND UP PADDLEBOARD

RELATED APPLICATION

This application claims priority to provisional patent application U.S. Ser. No. 62/047,795 filed on Sep. 9, 2014, the entire contents of which is herein incorporated by reference.

BACKGROUND

The embodiments herein relate generally to watercraft.

Prior to embodiments of the disclosed invention, a rigid single hull, inflatable or hard material, stand up paddle board when on water requires constant adjustments in the participant's center of balance to maintain optimal bipedal posture aligned in its horizontal gravitational vector. The rapidly shifting center of balance is a challenge to correct because there is a constant and abrupt leaning (heeling) angle that is greatly amplified because the stand-up paddleboard is one fixed surface. As a biped that utilizes two legs, hips, knees and ankles to maintain its balance standing on this single abruptly leaning surface is much more difficult than being on two independently moving surfaces. Embodiments of the disclosed invention solve this problem.

SUMMARY

A split stand up paddle board is configured to provide stability for a top-heavy load. The split stand up paddle board has a first hull attached to first hull inboard upper connection flap. A second hull is attached to second hull inboard upper connection flap. An upper string connects the first hull inboard upper connection flap to the second hull inboard upper connection flap. The upper string prevents the first hull from collapsing against the second hull when under the top-heavy load.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
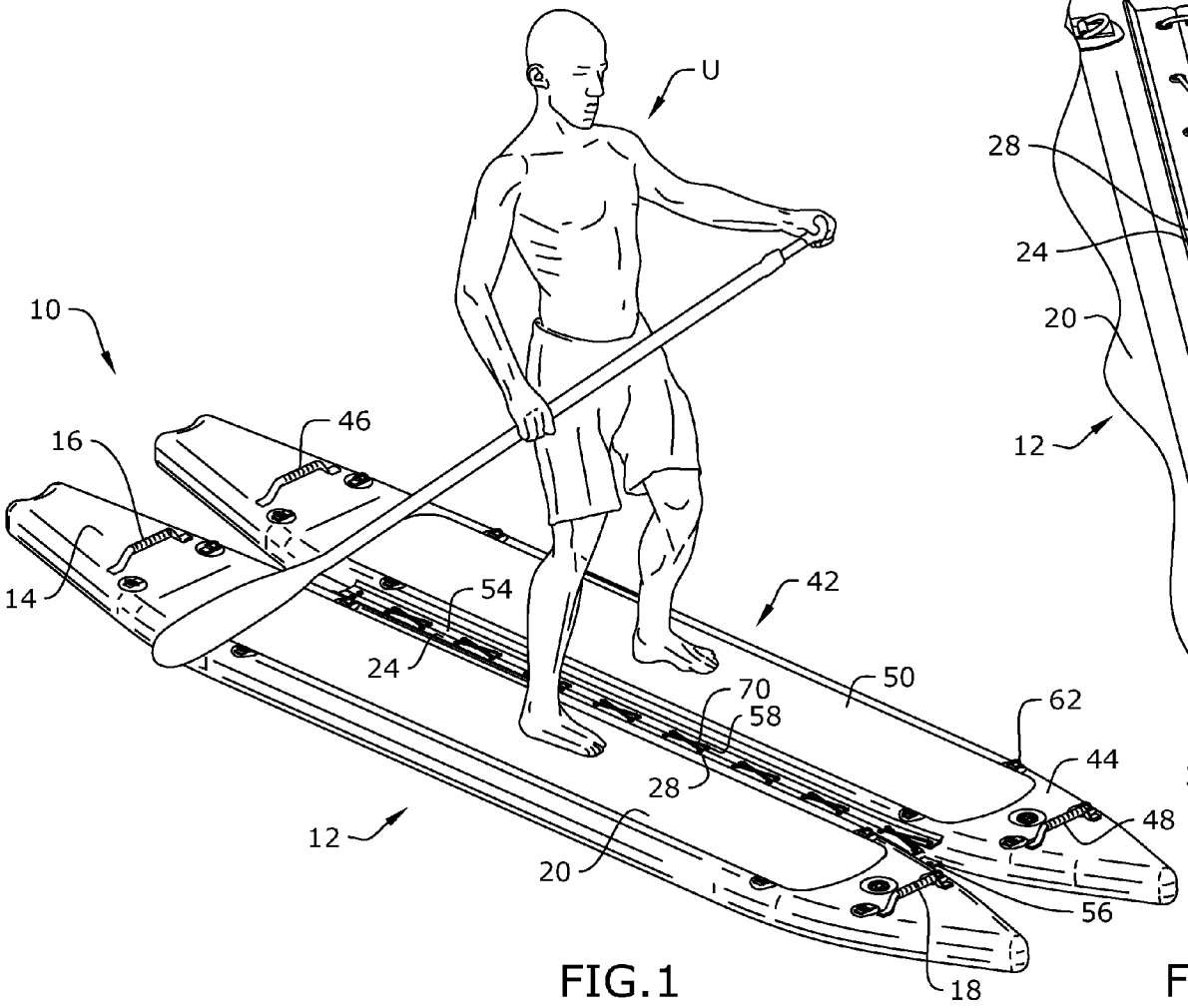
FIG. 1 is a perspective view of an embodiment of the invention shown in use.
Figure 8:
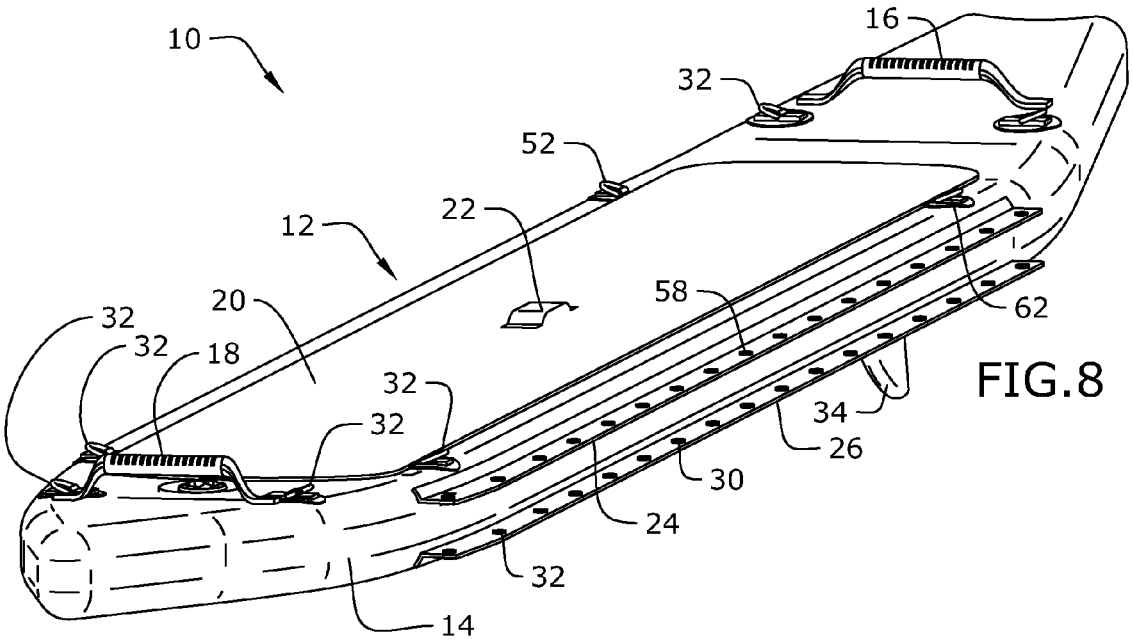
FIG. 8 is a top perspective view of an embodiment of the invention.
Figure 9:
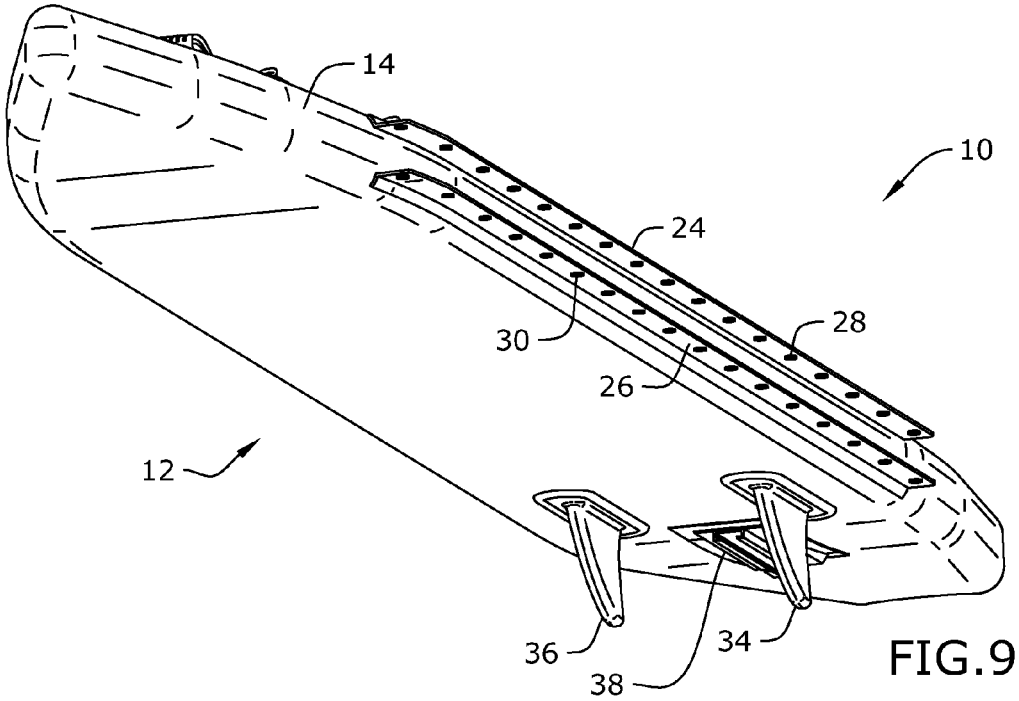
FIG. 9 is a bottom perspective view of an embodiment of the invention.

By way of example, and referring to FIG. 1, FIG. 8 and FIG. 9, user U desires to use a stand up paddleboard, but is new to the sport. As a result, user U does not have very good balance and would fall from a traditional paddleboard. Further, naval architecture indicates that user U is a top-heavy load that requires stability to stay upright. One embodiment of split stand up paddle board 10 solves this problem. Split stand up paddle board 10 comprises first board 12. First board 12 further comprises first hull 14 attached to first hull first handle 16 and first hull second handle 18. Between first hull first handle 16 and first hull second handle 18, first hull 14 is attached to first hull top surface pad 20. First hull top surface pad 20 is further attached to first hull foot anchor strap 22. First hull 14 is further attached to first hull inboard upper connection flap 24 and first hull inboard lower connection flap 26.

First hull inboard upper connection flap 24 and first hull inboard lower connection flap 26 are substantially parallel to one another and cover a distance of at least 60% of the length of first hull 14 from both to stern. First hull inboard upper connection flap 24 is mechanically coupled to a plurality of first hull inboard upper connection grommets 28. First hull inboard lower connection flap 26 is mechanically coupled to a plurality of first hull inboard lower connection grommets 30. The plurality of first hull inboard upper connection grommets 28 and the plurality of first hull inboard lower connection grommets 30 are substantially concentric to one another such that for each first hull inboard upper connection grommet 28 having a center that could be bisected with a centerline, that center line would travel through one of the plurality of first hull inboard lower connection grommets 30 as well. First hull 14 is attached to a plurality of D-rings 32. First hull 14 is further mechanically coupled to first hull inboard fin 34, first hull outboard fin 36 and first hull bottom handle 38.

Figure 3:
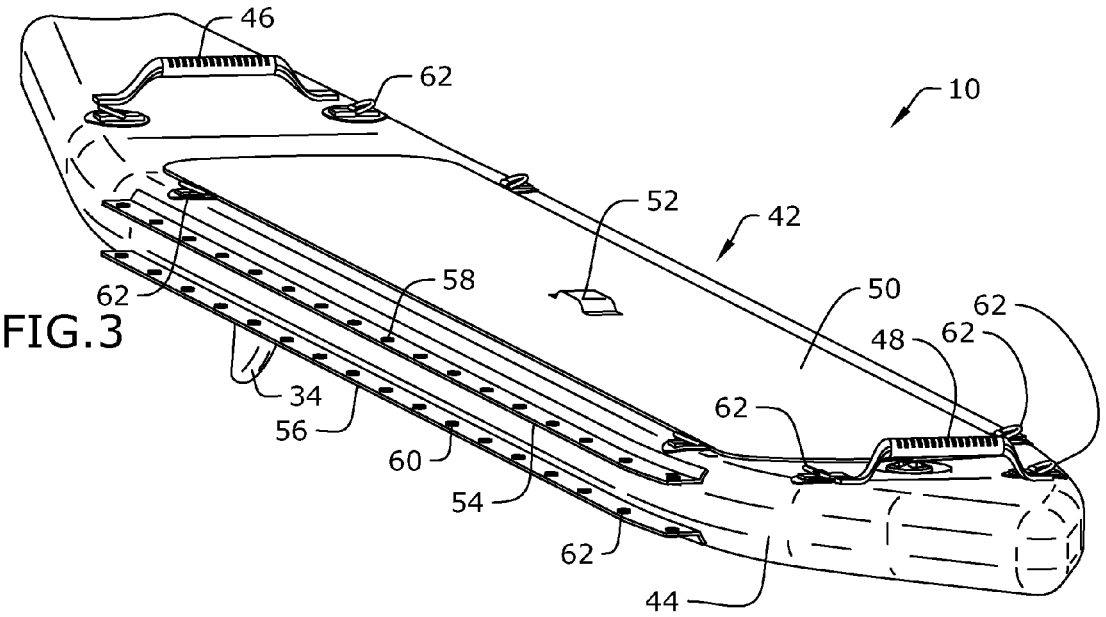
FIG. 3 is a top perspective view of an embodiment of the invention.
Figure 4:
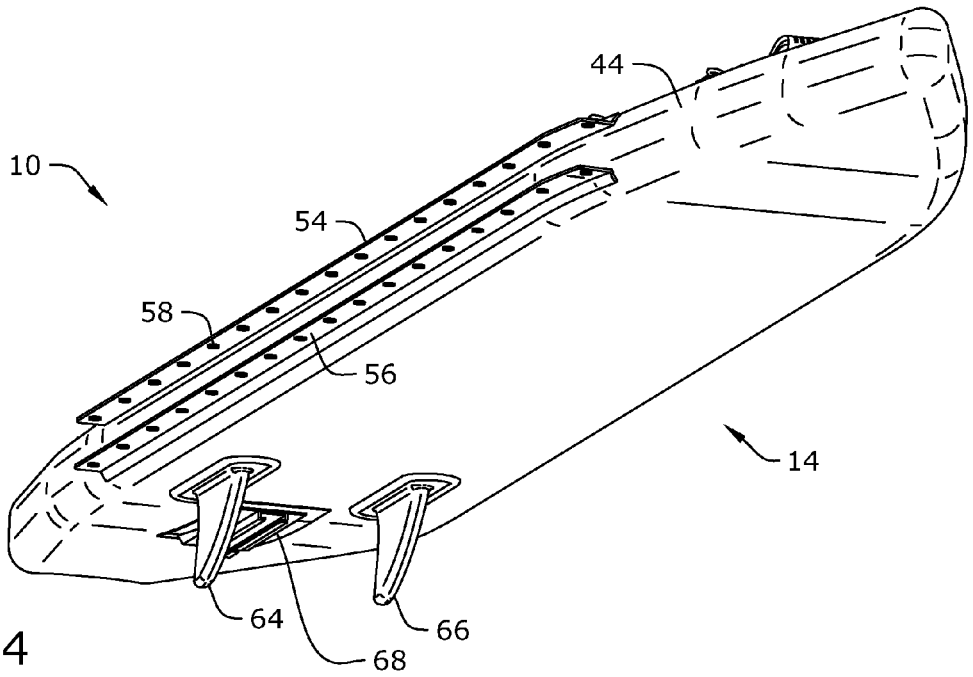
FIG. 4 is a bottom perspective view of an embodiment of the invention.

Turning to FIG. 1, FIG. 3 and FIG. 4, split stand up paddle board 10 comprises second board 42. Second board 40 further comprises second hull 44 attached to second hull first handle 46 and second hull second handle 48. Between second hull first handle 46 and second hull second handle 48, second hull 44 is attached to second hull top surface pad 50. Second hull top surface pad 50 is further attached to second hull foot anchor strap 52. Second hull 44 is further attached to second hull inboard upper connection flap 54 and second hull inboard lower connection flap 56.

Second hull inboard upper connection flap 54 and second hull inboard lower connection flap 56 are substantially parallel to one another and cover a distance of at least 60% of the length of second hull 44 from both to stern. Second hull inboard upper connection flap 54 is mechanically coupled to a plurality of second hull inboard upper connection grommets 58. Second hull inboard lower connection flap 56 is mechanically coupled to a plurality of second hull inboard lower connection grommets 60. The plurality of second hull inboard upper connection grommets 58 and the plurality of second hull inboard lower connection grommets 60 are substantially concentric to one another such that for each second hull inboard upper connection grommet 58 having a center that could be bisected with a centerline, that center line would travel through one of the plurality of second hull inboard lower connection grommets 60 as well. Second hull 44 is attached to a plurality of D-rings 62. Second hull 44 is further mechanically coupled to second hull inboard fin 64, second hull outboard fin 66 and first hull bottom handle 68.

Figure 2:
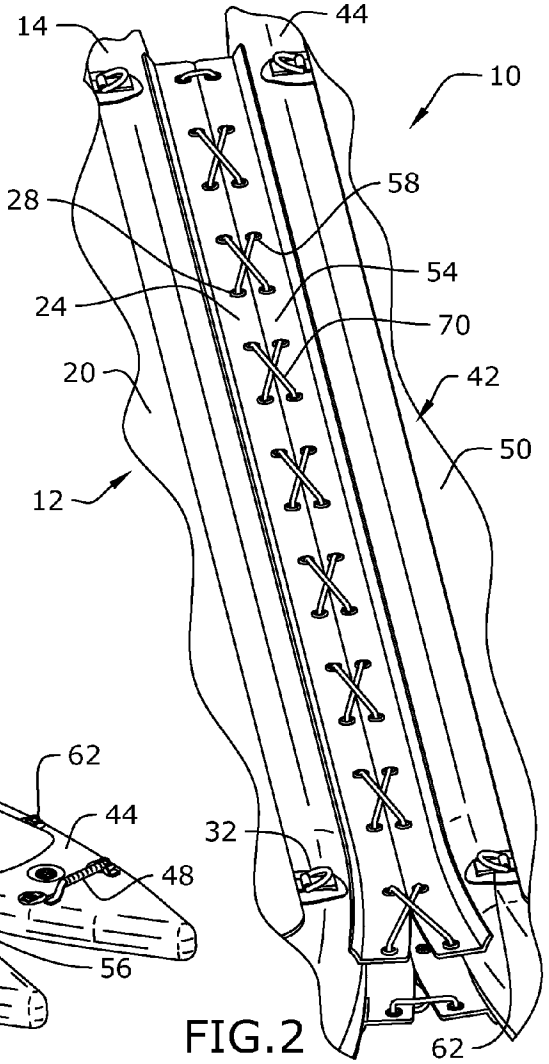
FIG. 2 is detail perspective view of an embodiment of the invention demonstrating attachment method.

As shown in FIG. 2, first hull inboard upper connection flap 24 can be joined to second hull inboard upper connection flap 54 with upper string 70. Upper string 70 is threaded through the first hull inboard upper connection grommets 28 and the second hull inboard upper connection grommets 58. Similarly, first hull inboard lower connection flap 26 can be joined to second hull inboard lower connection flap 56 with lower string 72. Lower string 72 is threaded through the plurality of first hull inboard lower connection grommets 30 and the plurality of second hull inboard lower connection grommets 60.

Figures 5, 6:
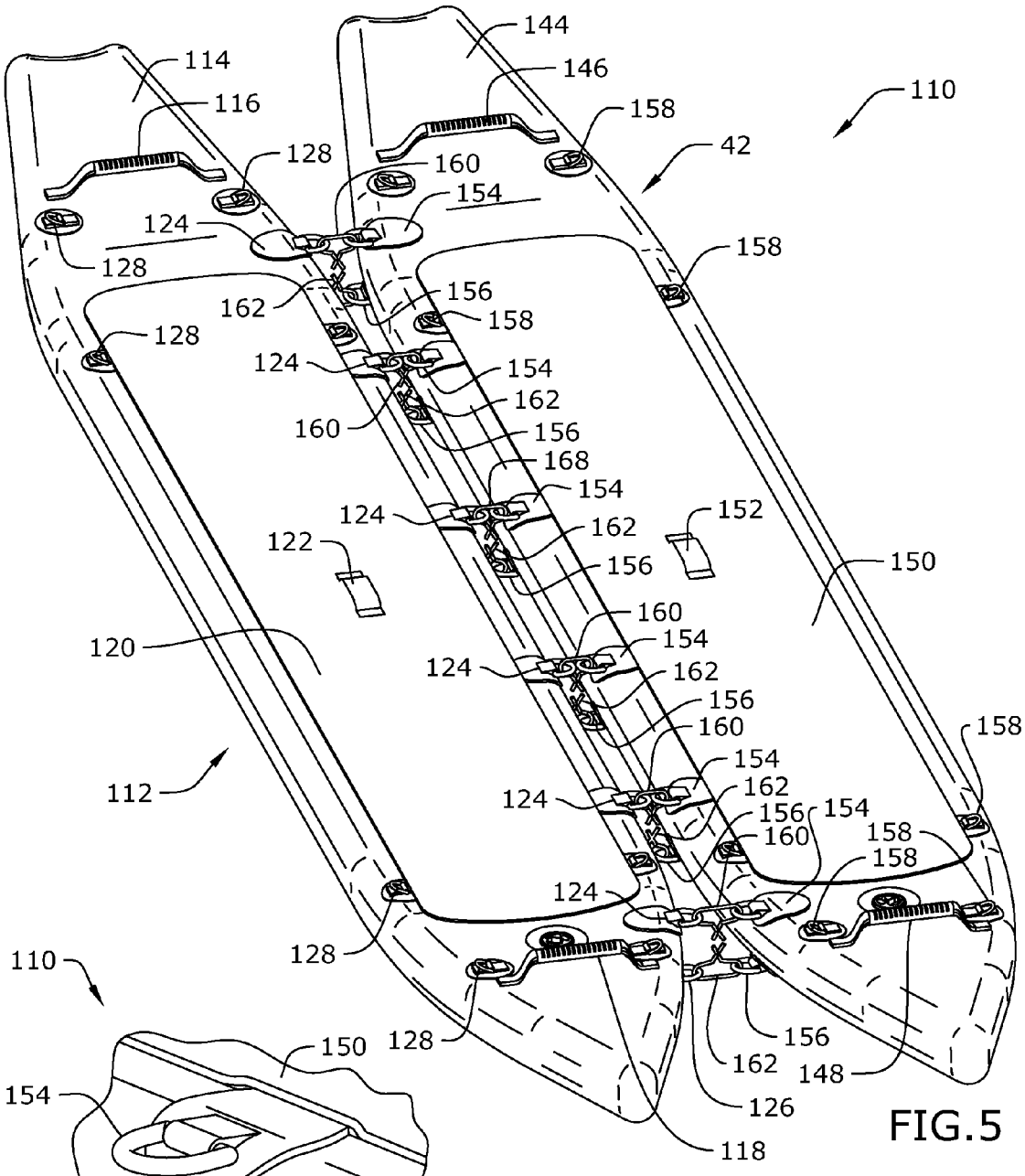
FIG. 5 is perspective view of an embodiment of the invention.
FIG. 6 is a detail perspective view of the left side of the second body of the invention (the right side being a mirror image thereof).

Turning to FIG. 5 and FIG. 6, split stand up paddle board 110 comprises first board 112. First board 112 further comprises first hull 114 attached to first hull first handle 116 and first hull second handle 118. Between first hull first handle 116 and first hull second handle 118, first hull 114 is attached to first hull top surface pad 120. First hull top surface pad 120 is further attached to first hull foot anchor strap 122. First hull 114 is further attached to a plurality of first hull upper attachment D-rings 124 and a plurality of first hull lower attachment D-rings 126. First hull 114 is further attached to a plurality D-rings 128.

Second board 142 further comprises second hull 144 attached to second hull first handle 146 and second hull second handle 148. Between second hull first handle 146 and second hull second handle 148, second hull 144 is attached to second hull top surface pad 150. Second hull top surface pad 150 is further attached to second hull foot anchor strap 152. Second hull 144 is further attached to a plurality of second hull upper attachment D-rings 154 and a plurality of second hull lower attachment D-rings 156. Second hull 144 is further attached to a plurality D-rings 158.

Each first hull upper attachment D-ring 124 can be attached to a second hull upper attachment D-ring 154 with an upper tie 160. Similarly, each first hull lower attachment D-ring 126 can be attached to a second hull lower attachment D-ring 156 with lower tie 162.

Figure 7:
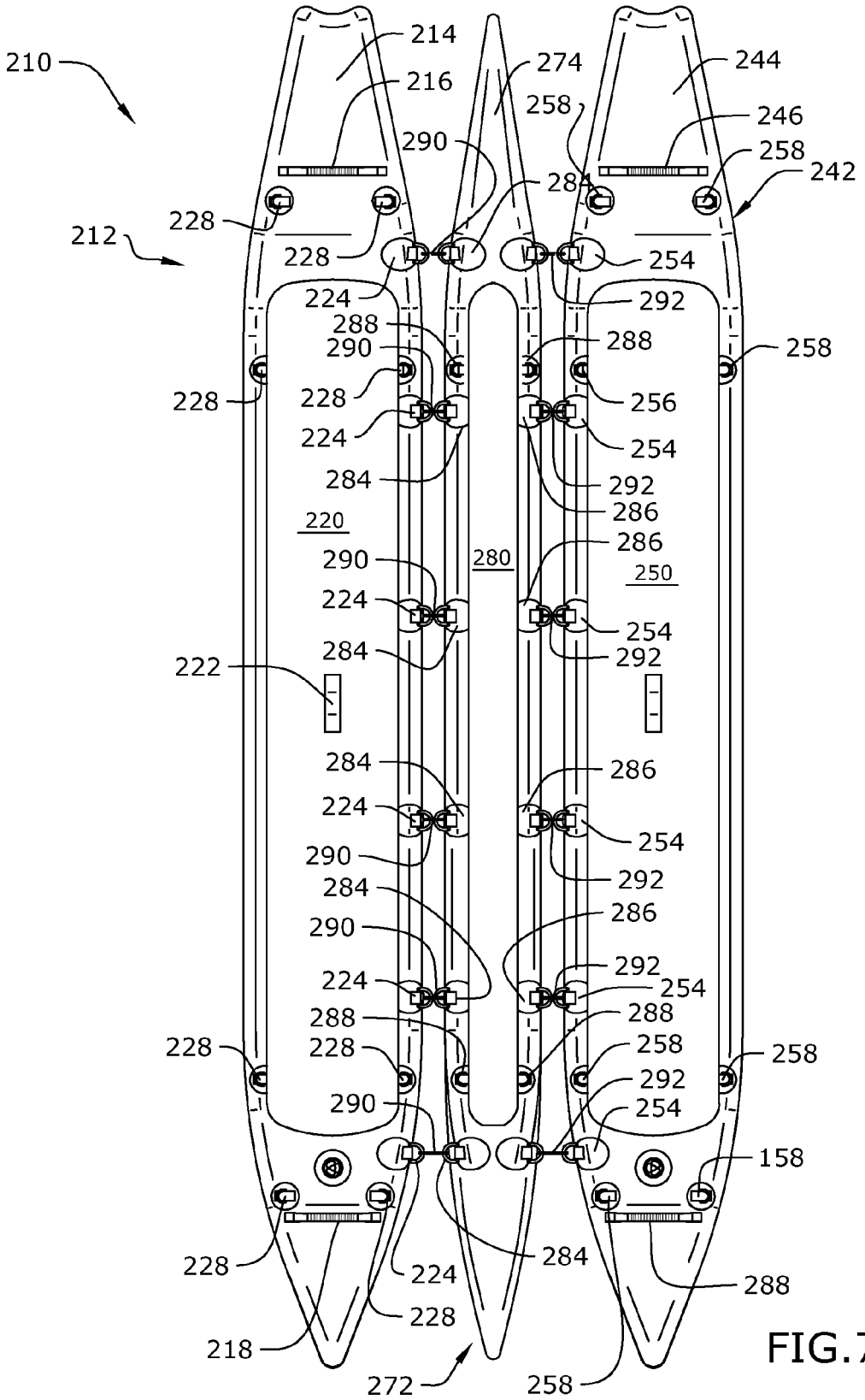
FIG. 7 is a top profile view of an embodiment of the invention.

Turning to FIG. 7 and FIG. 6, split stand up paddle board 210 comprises first board 212. First board 212 further comprises first hull 214 attached to first hull first handle 216 and first hull second handle 218. Between first hull first handle 216 and first hull second handle 218, first hull 214 is attached to first hull top surface pad 220. First hull top surface pad 220 is further attached to first hull foot anchor strap 222. First hull 214 is further attached to a plurality of first hull upper attachment D-rings 224. First hull 214 is further attached to a plurality D-rings 228

Second board 242 further comprises second hull 244 attached to second hull first handle 246 and second hull second handle 248. Between second hull first handle 246 and second hull second handle 248, second hull 244 is attached to second hull top surface pad 250. Second hull top surface pad 250 is further attached to second hull foot anchor strap 252. Second hull 244 is further attached to a plurality of second hull upper attachment D-rings 254. Second hull 244 is further attached to a plurality D-rings 258.

Third board 272 further comprises third hull 274 attached to third hull top surface pad 280. Third hull 274 is further attached to a plurality of third hull upper attachment first side D-rings 284 and a plurality of third hull upper attachment second side D-rings 286. Third hull 274 is further attached to a plurality D-rings 288.

Each first hull upper attachment D-ring 224 can be attached to a third hull upper attachment first side D-rings 284 with a first side tie 290. Each second hull upper attachment D-ring 254 can be attached to a third hull upper attachment second side D-rings 286 with a first side tie 292.

In some embodiments, the third hull can be made of a rigid material such as fiberglass, but in other embodiments, the hull can be made of a material that can be inflated. When the third hull is inflated it can be inflated in sections, this permits some of the first hull upper attachment D-rings 224 to move further from the third hull upper attachment first side b-rings 284 that other first hull upper attachment D-rings 224. This creates dynamic balancing that can be helpful for a new user.

The naval architecture works like this. A load moved outboard from the centerline of a vessel decreases stability. However, the connection of an additional hull with upper and lower connection points, has the second hull create an external righting arm on the first hull which increases stability.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A split stand up paddle board, configured to provide stability for a top-heavy load, the split stand up paddle board comprises:

a first hull attached to first hull inboard upper connection flap;

a second hull attached to second hull inboard upper connection flap;

an upper string, connecting the first hull inboard upper connection flap to the second hull inboard upper connection flap;

wherein the upper string prevents the first hull from collapsing against the second hull when under the top-heavy load;

a first hull inboard lower connection flap attached to the first hull;

a second hull inboard lower connection flap attached to the second hull; and a lower string, connecting the first hull inboard lower connection flap and the second hull inboard lower connection flap.

2. The split stand up paddle board of claim 1, further comprising:

a first hull first handle and a first hull second handle, attached to the first hull;

a first hull top surface pad, attached to the first hull between the first hull first handle and the first hull second handle; and a first hull foot anchor strap, attached to the first hull top surface pad.

3. The split stand up paddle board of claim 2, further comprising:

a second hull first handle and a second hull second handle, attached to the second hull;

a second hull top surface pad, attached to the second hull between the second hull first handle and the second hull second handle; and a second hull foot anchor strap, attached to the second hull top surface pad.

4. A split stand up paddle board, configured to provide stability for a top-heavy load, the split stand up paddle board comprises:

a first hull attached to a plurality of first hull upper attachment D-rings;

a second hull attached to a plurality of second hull upper attachment D-rings; and a plurality of upper ties, wherein an upper tie connects each first hull upper attachment D-ring to a corresponding second hull upper attachment D-ring;

wherein the plurality of upper ties prevents the first hull from collapsing against the second hull when under the top-heavy load a plurality of first hull lower attachment D-rings;

a plurality of second hull lower attachment D-rings;

a plurality of lower ties, wherein an lower tie connects each first hull lower attachment D-ring to a corresponding second hull lower attachment D-ring.

5. The split stand up paddle board of claim 4, further comprising:

a first hull first handle and a first hull second handle, attached to the first hull;

a first hull top surface pad, attached to the first hull between the first hull first handle and the first hull second handle; and a first hull foot anchor strap, attached to the first hull top surface pad.

6. The split stand up paddle board of claim 5, further comprising:

a second hull first handle and a second hull second handle, attached to the second hull;

a second hull top surface pad, attached to the second hull between the second hull first handle and the second hull second handle; and a second hull foot anchor strap, attached to the second hull top surface pad.

* * * * *